US005285014A

United States Patent [19]

Gilchrist

[11] Patent Number: 5,285,014

[45] Date of Patent: Feb. 8, 1994

[54] PAINT SHIELD FOR ELECTRICAL OUTLETS AND SWITCHES

[76] Inventor: Gayland Gilchrist, 1615 Warwickshire, Houston, Tex. 77072

[21] Appl. No.: 804,943

[22] Filed: Dec. 11, 1991

[51] Int. Cl.[5] ..... B05C 11/00

[52] U.S. Cl. ..... 174/67; 16/DIG. 2; 118/505; 200/333; 439/135

[58] Field of Search ..... 174/67; 220/242; 16/DIG. 2; 118/504, 505; 439/135; 200/333

[56] References Cited

U.S. PATENT DOCUMENTS

| | | | |
|---|---|---|---|
| 2,439,708 | 4/1948 | Abraham | 174/67 X |
| 2,672,122 | 3/1954 | Kupec | 118/505 |
| 4,293,173 | 10/1981 | Tricca | 174/67 X |
| 5,003,128 | 3/1991 | Grondin | 174/67 |

*Primary Examiner*—Leo P. Picard
*Assistant Examiner*—David A. Tone
*Attorney, Agent, or Firm*—Bush, Moseley & Riddle

[57] ABSTRACT

In accordance with illustrative embodiments of the present invention, a paint shield that covers all exposed surfaces of an electrical outlet or switch assembly and its cover plate includes a front wall having top, bottom and side walls extending rearward thereof, and devices such as a pair of prongs or a suction cup which temporarily attach the shield to the assembly with the rear edge sections of the top, bottom and side walls positioned tightly against the adjacent side surfaces of the cover plate. The shield has a handling tab on the front wall that is longitudinally aligned with the prongs or suction cup.

9 Claims, 2 Drawing Sheets

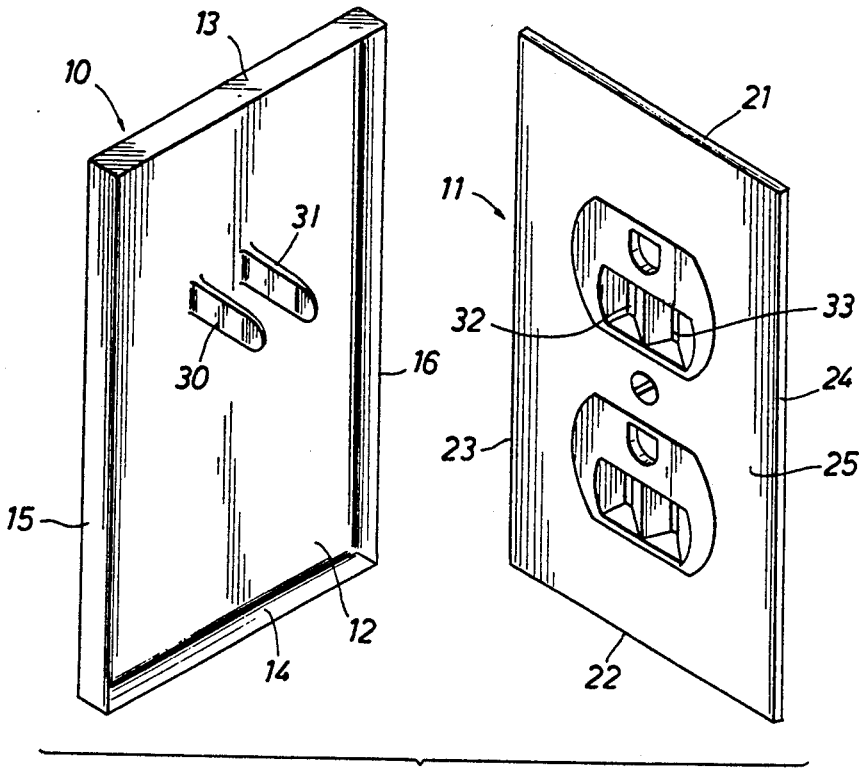
FIG. 1
FIG. 2
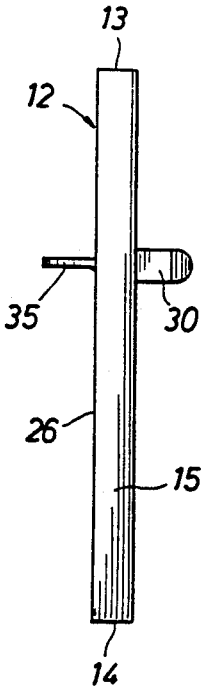
FIG. 3
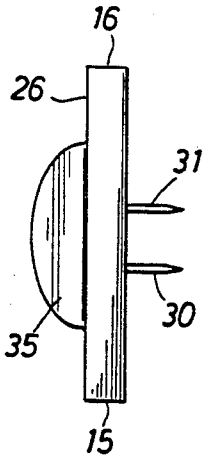
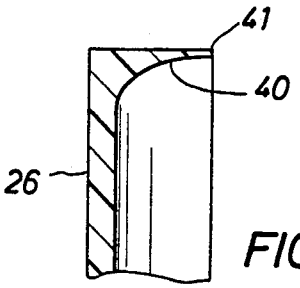
FIG. 4
FIG. 5
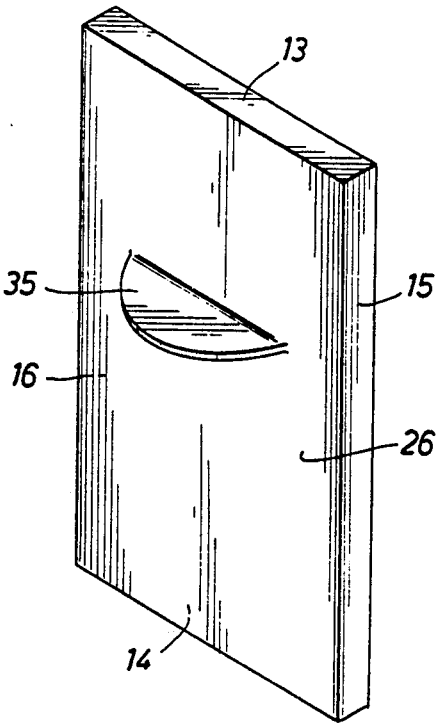

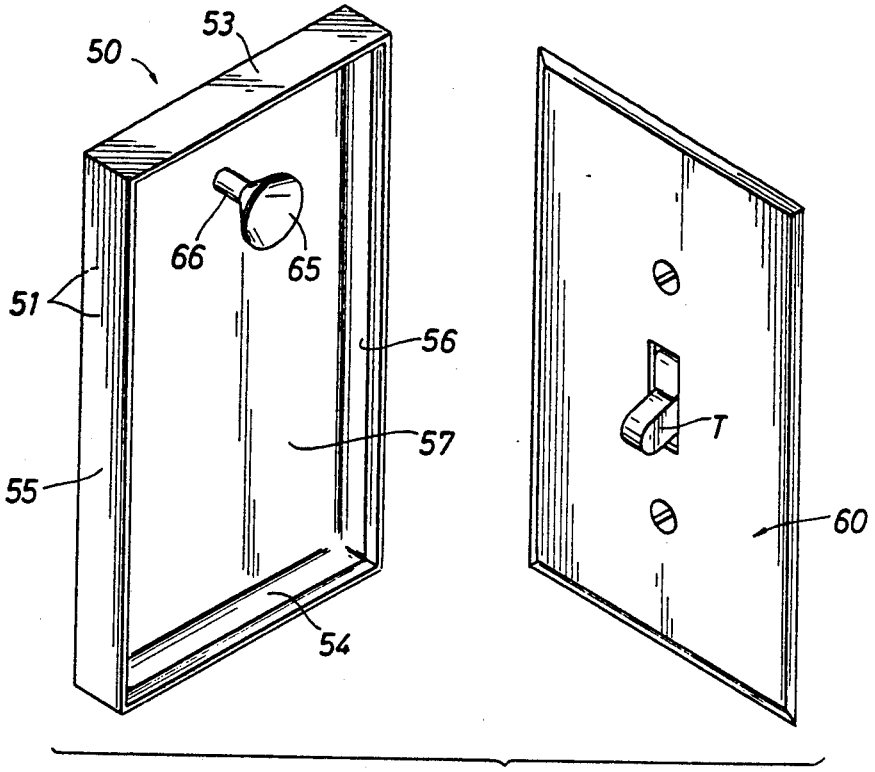
FIG. 6
FIG. 7
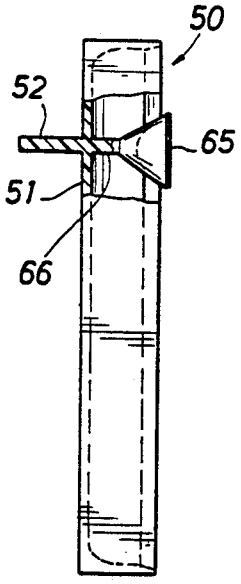
FIG. 8
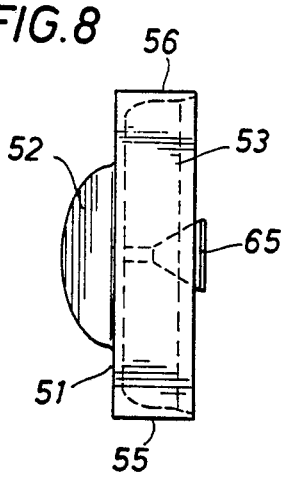
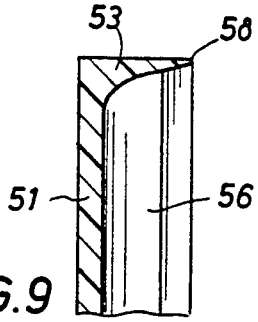
FIG. 9
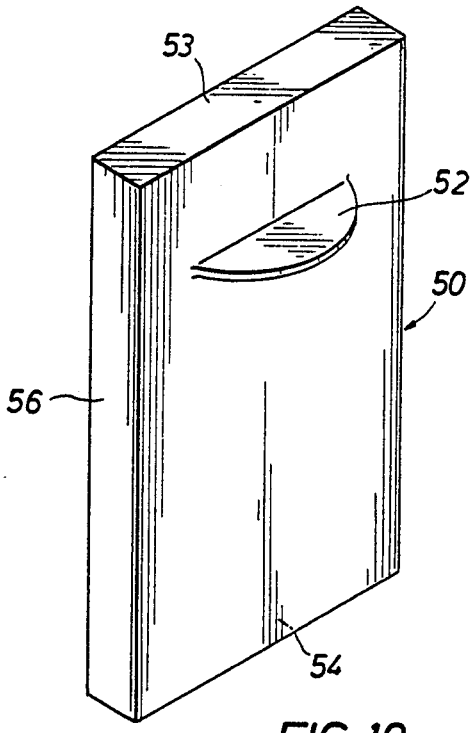
FIG. 10

PAINT SHIELD FOR ELECTRICAL OUTLETS AND SWITCHES

FIELD OF THE INVENTION

This invention relates generally to a paint shield for electrical outlets and switches, and particularly to a new and improved shield that temporarily fastens to the cover plate of an outlet or a switch and prevents paint from coming into contact therewith while the room is being painted.

BACKGROUND OF THE INVENTION

When a room that has electrical fixtures such as outlets and switches is being painted with a new coat, it is unsightly if the paint is applied, inadvertently or otherwise, to the cover plates and other exposed surfaces of electrical outlets or switches. Thus the common practice is for the painter to detach the cover plates, and to use masking tape or the like to temporarily cover the other exposed surfaces. Alternatively, masking tape can be used to cover all outer surfaces on the switch or outlet. However, it is time consuming to remove the plates with a screwdriver and then replace them after painting, and of course masking tape must be positioned and later removed. It is a fairly common occurrence for the paint to flow past the edges of the tape, so that some paint removal and cleanup still is required. Quite often not all of the paint is in fact removed and presents an unsightly appearance requiring further cleanup.

An object of the present invention is to provide a new and improved paint shield for an electrical outlet or switch assembly.

Another object of the present invention is to provide a new and improved shield of the type described that can be quickly installed to provide total coverage of the plate and other exposed parts of an electrical switch or an outlet.

Still another object of the present invention is to provide a shield of the type described which is inexpensive to make and reliable in use and reuse, being readily attached to and later detached from an electrical outlet or switch before and after a wall painting operation.

Yet another object of the present invention is to provide a new and improved paint shield of the type described that completely covers the exposed surface of an electrical outlet or switch assembly during painting so that it is unnecessary to remove plates or to masking off any surfaces during painting.

SUMMARY OF THE INVENTION

These and other objects are attained in accordance with the present invention through the provision of a paint shield that includes a generally rectangular front wall which defines front and rear surfaces, and top, bottom and side walls that extend rearward of the front wall. In the case of a shield that is used to cover the plate and other exposed surfaces of an electrical outlet, the rear surface of the front wall is provided with a pair of parallel prongs that are inserted into the outlet receptacles in order to attach the shield in a manner such that the rear portions of its top, bottom and side walls fit tightly against the corresponding side surfaces of the cover plate. A tab on the outer side of the front wall opposite the prongs can be used as a handle to position and later remove the shield on and from the electrical outlet assembly. In the case of a shield for a light switch or the like having a toggle element, means such as a suction cup is used to temporarily attach the shield to the cover plate of the switch assembly. Hereagain the rear portions of the top, bottom and side walls of the shield engage the side walls of the switch cover plate to prevent paint from contacting any external exposed surface of the switch assembly. These walls have a front-to-rear dimension so that when the shield is in place, there is clearance between the rear surface of the front wall and the outermost surface of the toggle element.

In use, a shield is positioned on the cover plate of the outlet or switch assembly so that painting of adjacent room wall surfaces can be done without having to remove and later replace any components of the switch or outlet assemblies, and without using any masking tape. Once the adjacent room walls have been painted by brush or spray gun, the shield can be removed and used elsewhere in the room where needed. Of course a plurality of shields can be used to cover all the outlets or switches in the room to enable a continuous paint application, and the shields can be removed for subsequent use in another room when the application is finished.

BRIEF DESCRIPTION OF THE DRAWINGS

The present invention has other objects, features and advantages that will become more clearly apparent in connection with the following detailed description of preferred embodiments, taken in conjunction with the appended drawings in which:

FIG. 1 shows exploded, isometric rear and front views of a paint shield and an electric outlet that it covers in accordance with this invention;

FIG. 2 is a side elevation of the paint shield of FIG. 1;

FIG. 3 is a top elevation of the shield;

FIG. 4 is an enlarged, fragmentary, sectional view showing the configuration of a wall on the top, bottom or sides of the shield;

FIG. 5 is an isometric view of the front of the shield shown in FIG. 1;

FIG. 6 is a view similar to FIG. 1 of a shield embodiment for use with an electrical wall switch having a toggle element;

FIG. 7 is a side view of the shield shown in FIG. 6;

FIG. 8 is a top view of the shield of FIG. 6;

FIG. 9 is an enlarged, fragmentary sectional view of walls of this embodiment; and FIG. 10 is an isometric view of the shield of FIG. 6.

DETAILED DESCRIPTION OF PREFERRED EMBODIMENTS

Referring initially to FIG. 1, a shield indicated generally at 10 is shown opposite an electrical outlet assembly 11. When the shield 10 is positioned over the cover plate of the assembly 11, it will completely cover all exposed surfaces of the assembly during a paint job. The shield 10, which preferably is made of an injection molded plastic material, has a front wall 12 that is joined at its peripheral edges to a top wall 13, a bottom wall 14 and to opposite side walls 15, 16. Each of these walls project rearwardly of the front wall 12 as shown. The shield 10 is dimensioned such that the inner edge sections 17–20 of the respective side walls 10–16 fit closely against the side walls 21–24 of the cover plate 25 when the shield is positioned thereover to prevent paint from contacting any exposed surface of the assembly.

In order to temporarily attach the shield 10 to the outlet assembly 11, the rear side of the wall 12 can be provided with a pair of parallel projections or prongs 30, 31 having substantially the same size and dimensions as the contacts of an electrical plug that will mate with the upper receptacles 32, 33 of the outlet. Thus when the projections 30, 31 are pushed into the respective receptacles 32, 33, there is a slight interference fit which serves to attach the shield 10 to the outlet assembly 11. In order to easily position and later remove the shield 10, a tab 35 is formed on the outer surface 26 of the wall 12. The tab 35 can have a generally semi-circular shape as shown in FIGS. 3 and 5, although other shapes can be equally effective, to allow the fingers and thumb to be used to position and remove the shield 10. Preferably the tab 35 is positioned directly in front of the prongs 30, 31 so that there are no tilting forces generated as the shield 10 is attached to, or removed from, the outlet assembly 11.

In the preferred embodiments, the top, bottom and side walls 13–16 each have an inner surface 40 that curves and tapers toward the outer wall surface thereof as shown in FIG. 4. The tapered construction provides the walls with the thin edge sections 17–20 that are relatively flexible and dimensioned to provide a fairly tight fit against the respective side wall surfaces 21–24 of the cover plate 25. Thus when paint is applied to the wall surface thereto, it is inhibited from getting underneath the edge sections 17–20 and on the side or front surfaces of the cover plate 25.

FIGS. 6–10 show an embodiment 50 of the present invention that is used as a paint shield for an electrical wall switch of the type having a toggle element by which an associated fixture can be turned on and off. The front wall 51 is formed identically to the front wall of the previous embodiment, as is the tab 52. However the top, bottom and side walls 53–56 have a greater front-to-rear dimension so that rear surface 57 of the front wall 51 clears the outermost surfaces of the toggle (shown in phantom lines) in either its off or its on position. As shown in FIG. 9, the outer edge sections 58 of the top, bottom and side walls 53–56 are formed generally identical to the corresponding rear edge sections of the walls of the embodiment shown in FIGS. 1–5. Thus such walls are tapered toward the rear to provide a relatively thin dimension for the purposes mentioned above. This embodiment also is made out of an injection molded plastic material as a matter of preference.

To temporarily secure the shield 50 to the cover plate 60 of a wall switch assembly 61, an elastomer suction cup 65 can be employed. The cup 65 is mounted on the inner end of a rearwardly projecting post 66 which is molded as an integral part of the shield 50. Any suitable means for mounting the cup 65 on the end of the post 66 can be used. The post 66 is formed somewhat above where the prongs 30, 31 of the previous embodiment are formed, so that the cup 65 is positioned to engage a smooth outer surface of the cover plate 60 above the toggle element. Of course the concave side of the cup 65 faces rearward. The tab 52 can be grasped by the fingers and thumb to position and then push the shield 50 over and against the cover plate 60 so that the suction cup 65 is longitudinally foreshortened and flattened, to produce a negative pressure in the concavity which holds the shield in place. After painting is completed, the tab 52 can be grasped and pulled outward to break the suction of the cup 65 so that the shield 50 can be removed and reused elsewhere. The tab 52 preferably is aligned with the post 66 so that outward force is applied along the longitudinal centerline of the cup 65 during removal.

OPERATION AND USE

In use of the embodiment shown in FIGS. 1–5, the paint shield 10 is grasped by the tab 35, and the prongs 30, 31 are pushed into the receptacles 32, 33 of the outlet assembly 18 until the respective rear edge sections 17–20 of the top, bottom and side walls 13–16 cover the outer respective side surfaces 21–24 of the cover plate 25 of the outlet assembly 11. The prongs 30, 31 frictionally hold the shield 10 in place, and no external surfaces of the outlet assembly 11 are exposed to the application of paint. Once the wall regions around the outlet are painted, the shield 10 can be removed by pulling on the tab 35, and then reused at another outlet where needed. The embodiment shown in FIGS. 6–10 is handled in much the same way. As the suction cup 65 is foreshortened by pushing inward to the tab 52, air is expelled from its concavity. A negative pressure is formed by its inherent tendency to relax to its original configuration, which generates inwardly directed holding force. Since the tab 52 and the mounting post 66 are formed in alignment, the inward forces to set the cup 65, and the outward forces to release it, are applied generally along the central axis of the cup. Since each shield is made of a plastic with smooth outer surfaces, the paint that may be applied to its outer surfaces can be readily removed as desired, for example by rubbing with a paint thinner, or by scraping.

Of course the shield embodiment shown in FIG. 6–10 can be used as a cover for an electrical outlet assembly as well provided the suction cup 65 is mounted high enough on the rear surface of the front wall 51 to engage a smooth outer surface of the cover plate 25 above the upper receptacle. Of course, shields for covering multiple outlets or switches can be made as disclosed herein, and are considered to be within the scope of the present invention. A single prong can be used in lieu of the pair of prongs 30, 31 shown in FIG. 1–5, and a lower suction cup also can be provided in the embodiment shown in FIGS. 6–10.

The use of the paint shields of the present invention provides total coverage of all exposed parts of an electrical outlet or switch so that they are not contacted by paint, which makes it unnecessary to remove any cover plates or to mask any surfaces. The shields are inexpensive to make, and are reliable and easy to use and reuse. Since certain changes or modifications may be made in the disclosed embodiments without departing from the inventive concepts involved, it is the aim of the appended claims to cover all such changes and modifications falling within the true spirit and scope of the present invention.

What is claimed is:

1. A paint shield for an electrical wall outlet or switch assembly to prevent paint from contacting the cover plate of the assembly or any other exposed surfaces thereof as the wall is painted, comprising: a generally rectangular front wall having a front surface and a rear surface; top, bottom and side walls projecting rearward of said front wall and having continuous outer edge portions; and rearwardly projecting means on said rear surface of said front wall adapted to engage said assembly and hold said shield in position thereon; said edge portions of said top, bottom and side walls engaging the corresponding side wall surfaces of the cover plate to entirely cover all front and side surfaces of said assembly, said top, bottom and side walls being formed with thin edge sections on the rear portions thereof, said thin edge sections having a degree of resilience which allows them to be force-fitted over the side surfaces of the cover plate.

2. The shield of claim 1 wherein said rearwardly projecting means includes prong means arranged to be inserted into the receptacle means of the outlet assembly and frictionally engaged therewith.

3. The shield of claim 1 further including tab means on said front surface of said front wall for positioning said shield and for inserting said projecting means.

4. The shield of claim 2 wherein said prong means includes a pair of spaced-apart parallel members adapted to be simultaneously inserted into the receptacles of the outlet assembly.

5. The shield of claim 3 wherein said tab means is longitudinally aligned with said rearwardly projecting means.

6. The paint shield of claim 1 wherein said rearwardly projecting means includes suction cup means adapted to engage a front wall surface of the cover plate and secure said shield thereto.

7. The shield of claim 6 wherein said rearwardly projecting means includes a post on the rear side of said front wall, said suction cup means being mounted on the rear end of said post.

8. The shield of claim 1 wherein said top, bottom and side walls have front to rear dimensions such that when said shield is in place on the cover plate the rear surface of said front wall has clearance with a toggle element of a switch assembly.

9. The device of claim 1 wherein said shield is made of an injection molded plastic material and with a smooth external surface to facilitate removal of paint from such surfaces.

* * * * *